US006017256A

United States Patent [19]

Gillis et al.

[11] Patent Number: 6,017,256

[45] Date of Patent: Jan. 25, 2000

[54] HARD-SIDED WAKE BOARD AND WATER SKI BINDING

[75] Inventors: Donald B. Gillis, Lake Stevens; Douglas A. Cannon, Arlington, both of Wash.

[73] Assignee: Connelly Skis Inc., Lynnwood, Wash.

[21] Appl. No.: 09/189,345

[22] Filed: Nov. 10, 1998

Related U.S. Application Data

[63] Continuation-in-part of application No. 29/081,884, Jan. 7, 1998, Pat. No. Des. 404,454.

[51] Int. Cl.[7] ..... B63D 35/85

[52] U.S. Cl. ..... 441/70

[58] Field of Search ..... 441/68, 70; 36/117.1; 280/611, 615, 616, 623, 632

[56] References Cited

U.S. PATENT DOCUMENTS

| | | |
|---|---|---|
| 3,360,812 | 1/1968 | Kluge . |
| 3,801,119 | 4/1974 | Andre . |
| 3,965,585 | 6/1976 | Stewart . |
| 4,188,046 | 2/1980 | Fleckenstein . |
| 4,836,571 | 6/1989 | Corbisiero . |
| 4,891,027 | 1/1990 | Plunkett . |
| 4,979,760 | 12/1990 | Derrah . |
| 5,181,332 | 1/1993 | Uren et al. . |
| 5,277,635 | 1/1994 | Gillis . |
| 5,334,065 | 8/1994 | Uren et al. . |
| 5,499,837 | 3/1996 | Hale et al. . |
| 5,503,900 | 4/1996 | Fletcher . |
| 5,624,291 | 4/1997 | McClaskey . |
| 5,690,350 | 11/1997 | Turner et al. . |
| 5,868,594 | 2/1999 | Vukelic et al. ..... 441/70 |

*Primary Examiner*—Ed Swinehart

*Attorney, Agent, or Firm*—Christensen O'Connor Johnson Kindness PLLC

[57] ABSTRACT

A binding for a water ski or a wake board (20) for use on a wake board (21). The binding for a water ski or a wake board (20) securely attaches the rider's foot to the wake board (21). The binding for a water ski or a wake board (20) includes a holster (22) made of a semi-rigid material and that extends on opposite sides of the foot of the rider so as to close over the foot. A liner sock (24) extends over the foot of the rider and underneath the holster (22) and upward so as to receive the ankle and heel of the rider. A stretchable strap (26) extends from the bottom of the binding for a water ski or a wake board (20) and includes an annular cuff (24) that is fastenable about the ankle of the rider. The stretchable strap (26) permits a solid connection of the rider's ankle to the wake board (20), but stretches to release the rider's ankle and foot upon a fall. A buckle (66) extends over the holster (22) and includes a stretchable strap (68). The buckle (66) and the stretchable strap (68) are configured so that when the buckle is in an attached configuration, the buckle and the stretchable strap confine the holster (22) against a foot within the binding for a water ski or a wake board and the stretchable strap is capable of stretching so as to release a rider's foot within the binding for a water ski or a wake board when the rider falls.

8 Claims, 6 Drawing Sheets

HARD-SIDED WAKE BOARD AND WATER SKI BINDING

REFERENCE TO RELATED APPLICATION

This application is a continuation-in-part of design patent application Ser. No. 29/081,884, filed Jan. 7, 1998, now U.S. Pat. No. Des. 404,454.

FIELD OF THE INVENTION

This invention relates to foot bindings designed to be used on wake boards or water skis and, more specifically, a binding for a wake board or a water ski that includes an adjustable semi-rigid holster for holding the foot of a user.

BACKGROUND OF THE INVENTION

Wake boards are a form of recreational equipment upon which a person rides that is towed behind a boat or jet ski. A wake board resembles a surf board, and has bindings which attach the feet of a rider onto the top surface of the wake board.

One problem with prior art wake board and water ski bindings is that the bindings must hold the rider's foot in continuous contact with the top surface of the wake board, yet must be flexible enough to allow release of the rider upon a fall. Prior art bindings addressed these problems in a number of ways, but the majority of the bindings fell into two separate groups. A first group of the bindings were designed primarily of a stretchable material. The stretchable material was adjustable to fit many different foot sizes, and stretched to release a foot upon a fall. However, the designs were often uncomfortable, because the stretchable material had to be tensioned around the entire foot to hold the rider in place. An example of a prior art wake board binding having this construction can be found in U.S. Pat. No. 5,624,291 to McClaskey. The wake board binding in McClaskey includes two strips that are attached at the top of the wake board on opposite sides of a heel of a rider. The strips extend upward around the instep of the rider and are attached by hook and loop material. Attachment of the two strips binds the rider's foot to the upper surface of the wake board and maintains the rider's foot against the upper surface.

A second type of water ski or wake board bindings is formed of a semi-rigid material. For example, the two patents to Uren et al. (U.S. Pat. Nos. 5,181,332 and 5,334,065) disclose a water ski boot and binding including rigid side panels or cowls, rigid heel supports, and straps mounted over the instep of a foot portion of a rider. A rigid cuff extends around the ankle of the rider that is made as a monolithic tube of stiff semi-rigid or substantially rigid plastic material. A problem with this design is that it does not permit release of the rider's foot, but instead the boot releases from the ski upon a fall.

Another prior art wake board binding 10 is shown in FIG. 1. This binding includes a semi-rigid two piece (front 12 and rear 14) holster 16 for receiving the foot of a rider, surrounded by a flexible loop of material 18 that extends from one side of the foot, over the top of the foot, around the ankle, and back over the other side of the foot where it is attached. The flexible loop 18 is also attached around and below the heel. The binding 10 provides comfort for a rider in that the foot is received between the two semi-rigid panels 12, 14 of the holster 16, in contrast to the tensioned straps in other prior art bindings such as disclosed in McClaskey. However, the semi-rigid panels 12, 14 are not adjustable, and thus the bindings must be changed for a rider having a different sized foot.

There is a need for a wake board and water ski binding that provides the comfort of a semi-rigid boot, yet is adjustable to fit a number of different sized feet. Preferably, the binding would permit release of the rider upon a fall, to prevent injuries to the rider or damage to the bindings.

SUMMARY OF THE INVENTION

The present invention provides a novel wake board binding. In one embodiment, the wake board binding includes a semi-rigid left panel for fitting against the left side of a user's foot and a semi-rigid right panel for fitting against the right side of a rider's foot. The semi-rigid panels are flexible enough to allow movement of the panels toward and away from a foot between the panels, but rigid enough so that the panels do not bend at drastic angles. A buckle extends over the semi-rigid left panel and the semi-rigid right panel. The buckle includes a stretchable strap, and the buckle and the stretchable strap are configured so that when the buckle is in an attached configuration, the buckle and the stretchable strap confine the semi-rigid left panel and the semi-rigid right panel against a foot within the wake board binding and the stretchable strap is capable of stretching so as to release a rider's foot within the wake board binding when the rider falls.

A second buckle can be provided that extends over the semi-rigid left panel and the semi-rigid right panel. The second buckle is located forward of the first buckle so as to extend closer to the toes of a foot within the binding. The second buckle is configured so that when the second buckle is in an attached configuration, the second buckle confines the semi-rigid left panel and the semi-rigid right panel against a forward portion of a foot within the wake board binding.

In accordance with another aspect of the present invention, the wake board binding includes a first stretchable ankle connector having a lower portion of which is adapted to attach to a wake board and an ankle cuff releasably attachable about the circumference of an ankle of a rider and attached to the first stretchable ankle connector. The ankle cuff preferably is made of a stretchable material so as to permit release of the rider upon a fall, to prevent injuries to the rider or damage to the binding.

In accordance with another aspect of the present invention, the wake board binding includes a holster of semi-rigid material adapted to extend over the metatarsal portion of a foot of a rider. The holster in one embodiment includes a semi-rigid left panel for fitting against the left side of a rider's foot and a semi-rigid right panel for fitting against the right side of a rider's foot.

A second stretchable ankle connector can be provided that has a lower portion of which is adapted to attach to a wake board. The first and second ankle connectors are adapted to extend on opposite sides of an ankle located within the ankle cuff.

In accordance with yet another aspect of the present invention, a liner sock can be provided that extends into the holster and receives a foot of a rider.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
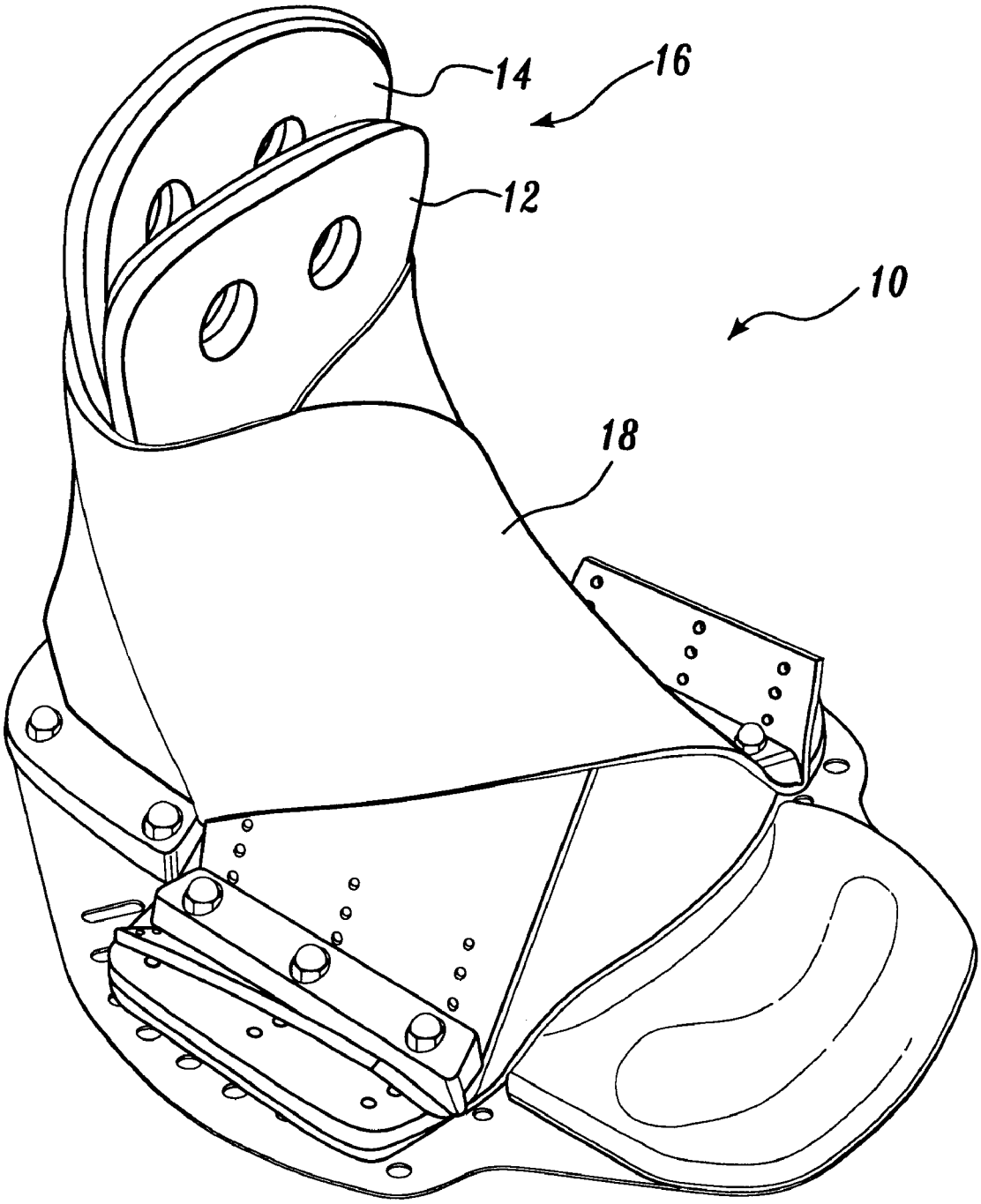
Fig. 1. (PRIOR ART)
FIG. 1 is a front side perspective of a prior art wake board binding.
Figure 2:
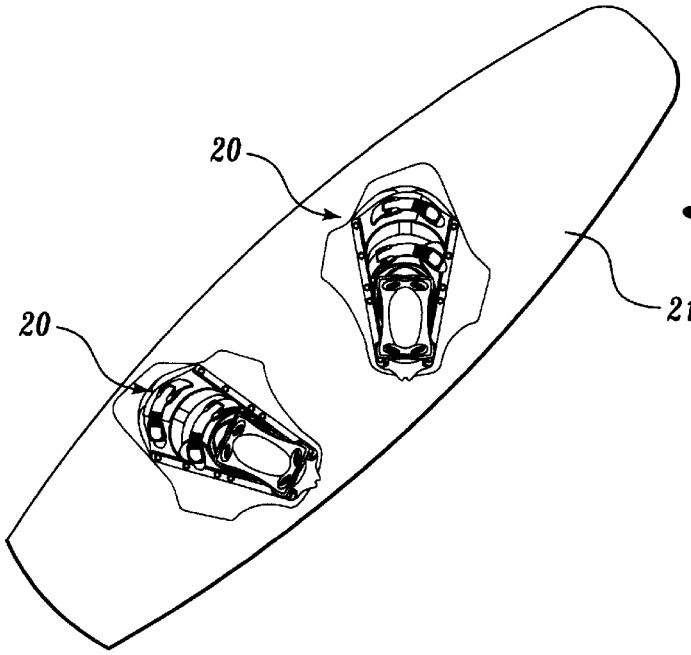
FIG. 2 is a top view of a wake board having two bindings that incorporate the present invention.

Referring now to the drawing, in which like reference numerals represent like parts throughout the several views, FIG. 2 discloses a pair of wake board bindings 20 incorporating the present invention. The wake board bindings 20 are shown as mounted on a wake board 21.

As described in detail below, each of the wake board bindings 20 securely attaches a rideres foot to the wake board 21. In addition, the wake board bindings 20 are adjustable to fit a variety of different foot sizes, and are stretchable so as to release a rider's foot and leg upon a fall.

In summary, each wake board binding 20 includes a holster 22 made of a semi-rigid material and that extends on opposite sides of the foot of the rider so as to close over the foot. A sock liner 24 extends between the foot of the rider and the underside of the holster 22, and continues upward so as to receive the ankle and heel of the rider. A stretchable strap 26 extends from the bottom of the wake board binding 20 and includes an annular cuff 28 that is fastenable about the ankle of the rider. The stretchable strap 26 provides a connection of the rider's ankle to the wake board 20, but stretches to release the rider's ankle and foot upon a fall. In addition, the holster 22 applies light pressure over the top of the rider's foot, so as to keep the foot against the top of the wake board 21.

Figure 4:
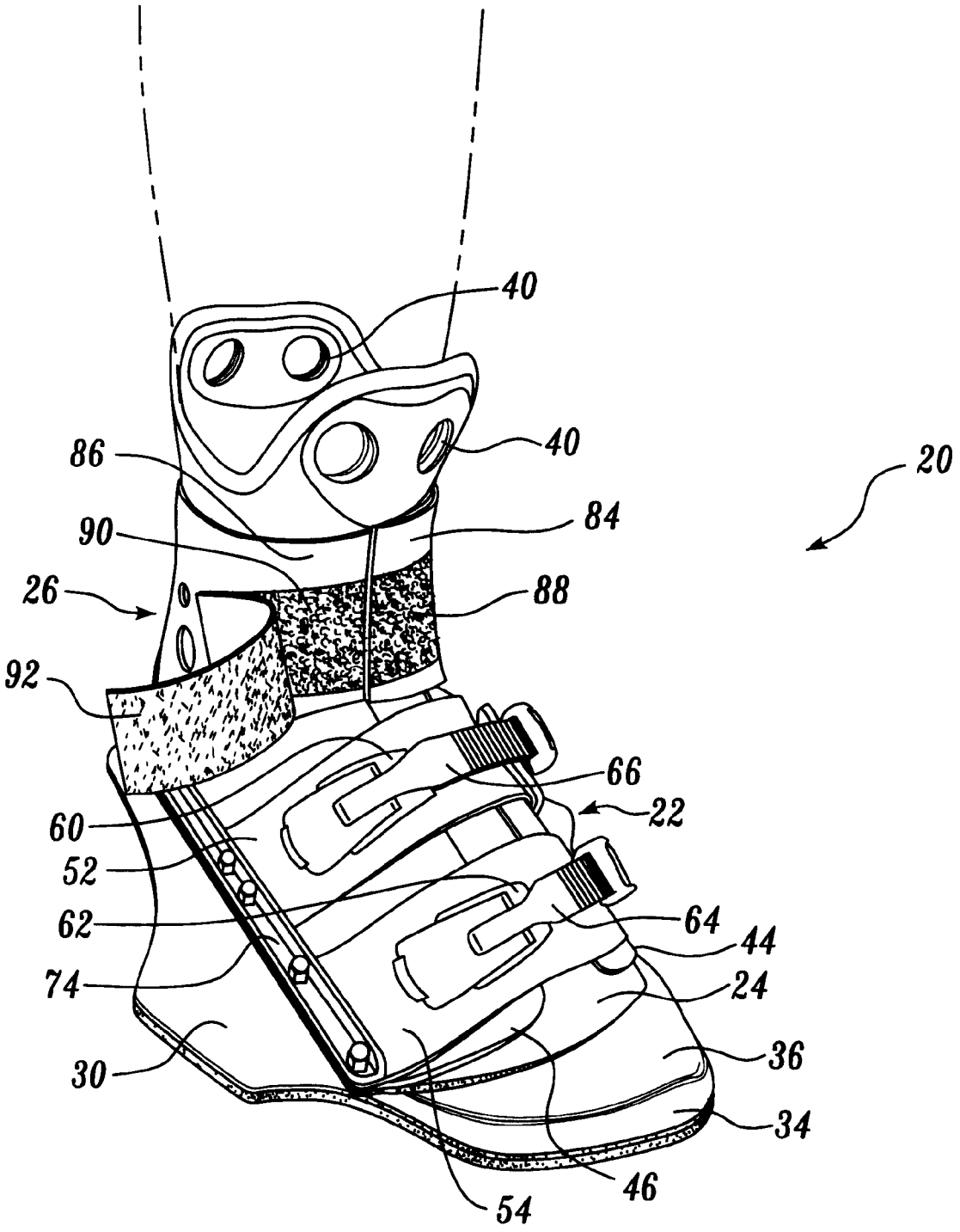
FIG. 4 is a side perspective view, similar to FIG. 3, with a hook and closure flap released.
Figure 8:
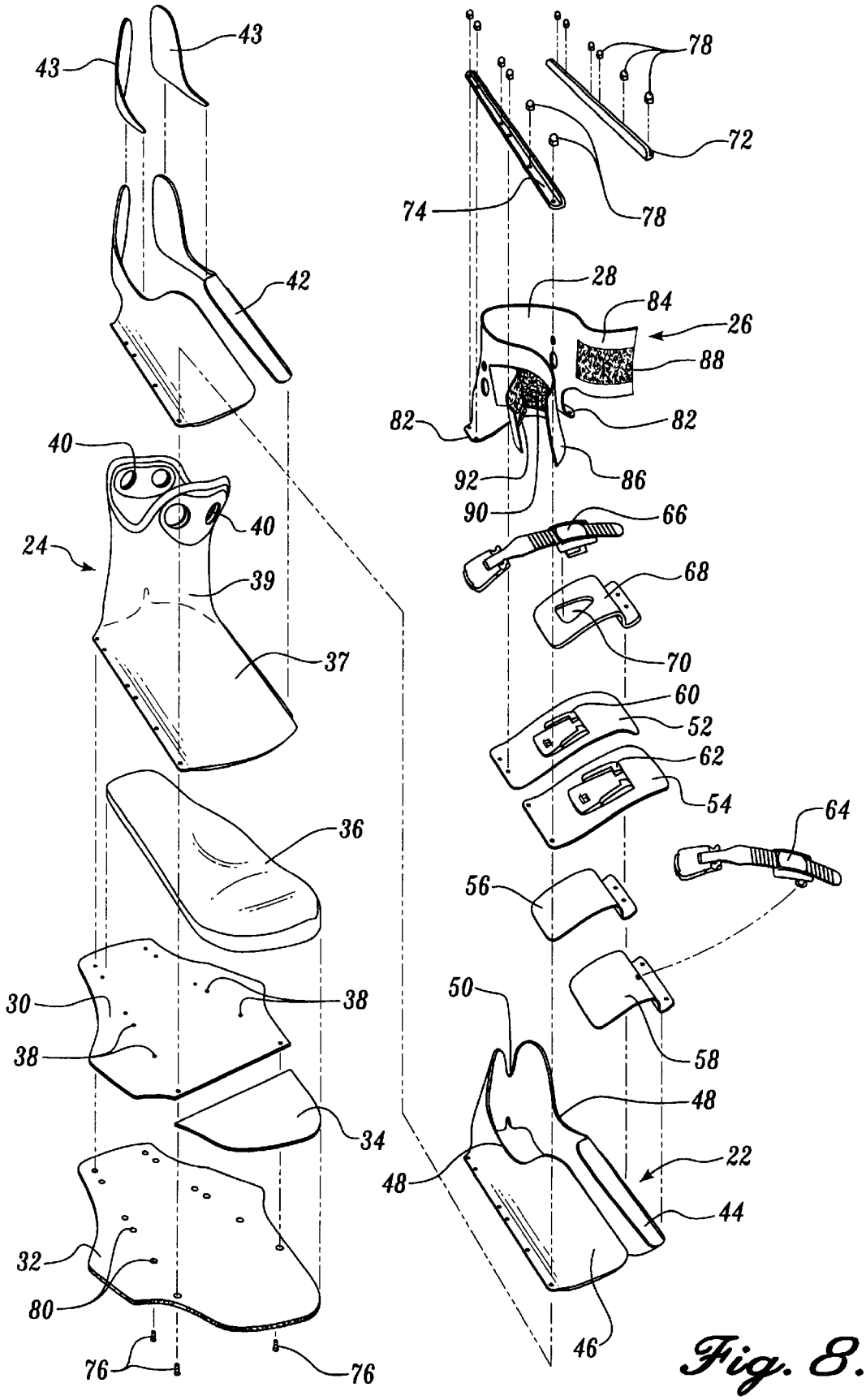
FIG. 8 is an exploded side perspective view of the wake board binding of FIG. 3.

The right foot wake board binding 20 (FIG. 4) will now be described in, more detail. As is best shown in FIG. 8, the wake board binding 20 is supported on a metal bottom support plate 30. A shock absorption pad 32 extends under the metal bottom support plate 30 and is aligned against the top surface of the wake board 21. The shock absorption pad 32 is preferably made of an elastomer material such as polyurethane so that the shock absorption pad dampens vibration from the wake board 21. The bottom support plate 30 extends the length of the shock absorption pad 32 with the exception of the toe region, which is covered by a toe region shock absorption pad 34. The toe region shock absorption pad 34 is preferably made of the same material as the shock absorption pad 32.

A foot cushion pad 36 extends the length of the bottom support plate 30 and over the toe region absorption pad 34. The upper surface of the foot cushion pad 36 is contoured to the shape of a rider's foot in a manner known in the art. A number of holes 38 extend transversely through the bottom support plate 30 along the outer edges of the foot cushion pad 36. The holes 38 are used for attachment of the liner sock 24 and the holster 22, as is described in detail below.

The liner sock 24 includes a top, dorsal surface 37 that is adapted to extend over the foot of a rider. The dorsal surface 37 includes an instep 39 which rises about the ankle of the rider. The underside of the liner sock 24 is open so as to receive the foot cushion pad 36. The liner sock 24 is arranged such that the toes of a rider can extend out beyond the front edge of the liner sock and over the front edges of the foot cushion pad 36. The liner sock 24 extends upward so as to receive the heel and ankle of a rider, and includes finger holes 40 for facilitating insertion of a foot into the liner sock. The liner sock 24 is constructed from a Neoprene material which is lined with Lycra material, and is commonly formed from a single sheet of the composite material.

The holster 22 fits over the liner sock and includes a layer of padding 42 therebetween. Ankle support pads 43 can also be provided that extend the height of the rearward edges of the holster 22. The holster 22 includes left and right semi-rigid panels 44, 46 for fitting over the metatarsal portion of a rider's foot. The holster 22 additionally includes recessed portions 48 for receiving the ankle bone of the user, and a rear recess 50 for receiving the Achilles tendon of the rider. The holster 22 is preferably formed of a semi-rigid plastic material that is flexible enough so as to separate and permit a foot to enter into or be removed from the liner sock 24, but has a structural integrity which is sufficient to serve to hold the spot in position when a rider is maneuvering the wake board 21 on the water. The holster 22 preferably is rigid enough so that it does not bend at drastic angles, which permits a rider's foot to be nested between the left and right semi-rigid panels 44, 46, but prevents pinching of the foot by the panels. A preferable material for use in the holster is Surlyn thermoplastic composite.

A pair of buckle anchor slide plates 52, 54 are attached to the right edge of the outside of the right semi-rigid panel 46 of the holster 22. The buckle anchor slide plates 52, 54 extend upward toward the central portion of the holster 22. Buckle anchors 60, 62 are located on the outside surfaces of the buckle anchor slide plates 52, 54.

Buckle slide plates 56, 58 are attached on the opposite side of the holster 22 and extend upward along the left rigid panel 44 and underneath the buckle anchor slide plates 52, 54. A first buckle 64 is riveted onto the forward buckle slide plate 58. The first buckle 64 is adapted to engage and lock into the buckle anchor 62 on the buckle anchor slide plate 54. By attaching the first buckle 64 in this manner, the forward portion of the metatarsal of the rider's foot is held between the semi-rigid panels 44, 46 of the holster 22.

The buckle slide plates 56, 58 and the buckle anchor slide plates 52, 54 are preferably made of a semi-rigid, slippery material such as Surlyn thermoplastic composite. The semi-rigid nature of the slide plates 52, 54, 56, 58 distributes the binding force from the buckles 64, 66 over the holster 22, and the slippery surfaces of the slide plates permit the slide plates to properly align so that the buckles are snugly fastened over the holster 22 and evenly distribute force around and over the holster.

A second buckle 66 is attached to a stretchable strap 68 that extends downward and is attached adjacent to the bottom support plate 30. The second buckle 66 attaches to the buckle anchor 60 in much the same fashion as the first buckle 64 attaches to the buckle anchor 62. The stretchable strap 68, however, permits release of a rider's foot from the liner sock 24 and the holster 22 upon a fall by stretching and releasing the rearward portion of the holster 22, and permitting the rearward portion of the left and right semi-rigid panels 44, 46 to move outward so as to release the foot. The stretchable strap 68 includes a hole 70 therethrough which permits easier attachment of the second buckle 66 and permits the stretchable strap 68 to stretch in the region of the hole with less resistance. The stretchable strap 68 is preferably formed of a flexible, resilient material such as neoprene rubber.

A pair of support rails 72, 74 extend along the outer edges of the holster 22 to attach the holster, the stretchable strap 26, the padding 42, the buckle anchor slide plates 52, 54, the buckle slide plates 56, 58, the liner sock 24, and the shock absorption pad 32 to the bottom support plate 30. A number of bolts 76 extend upward through the bottom of the bottom support plate 30 through each of these materials and out of the top of the support rails 72, 74. Nuts 78 are attached to the ends of the bolts to tighten the support rails 72, 74 toward the support plate 30 and to trap the materials into position. The heads of the bolts 76 extend through holes 80 in the shock absorption pad 32.

Figure 5:
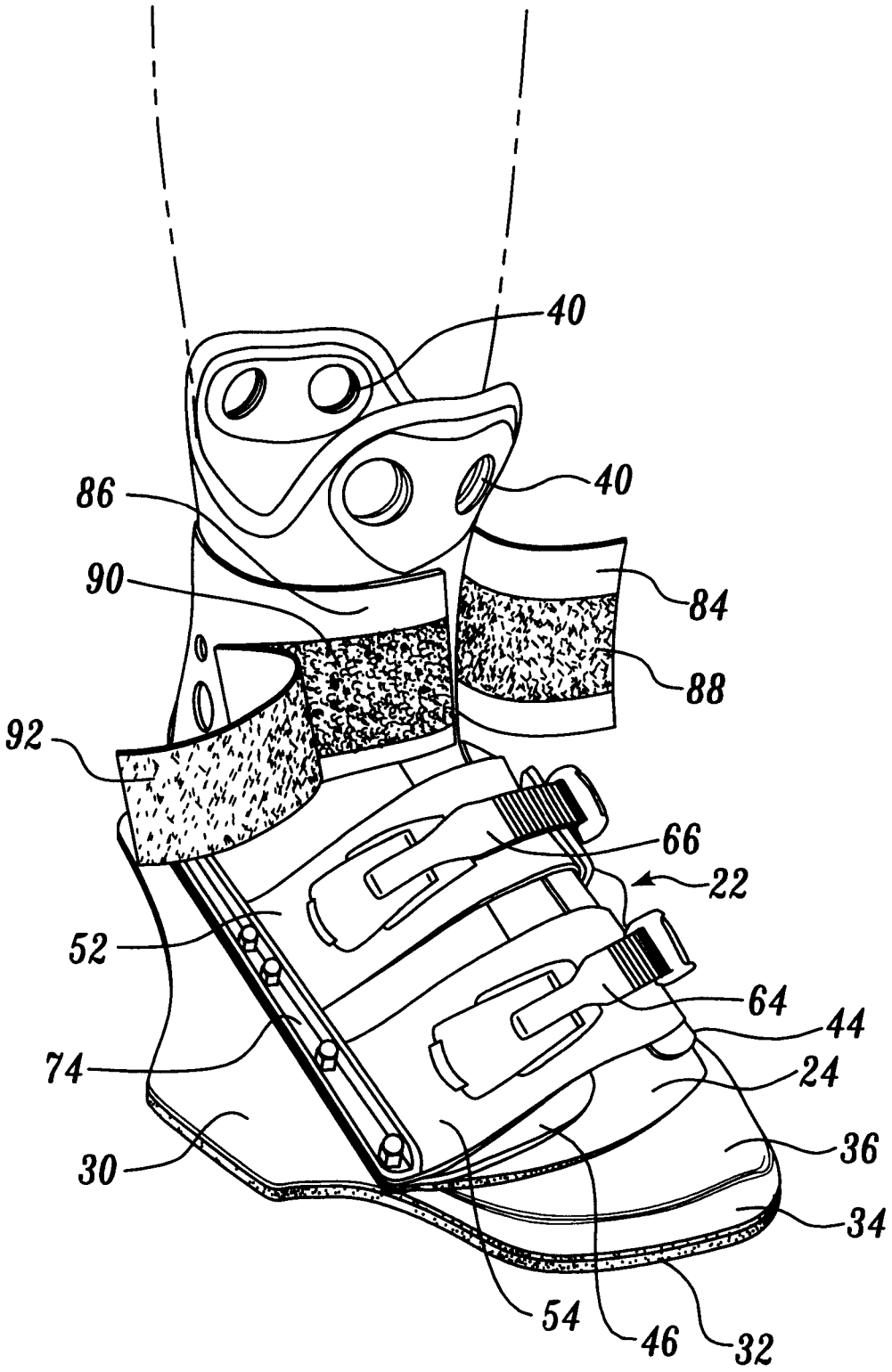
FIG. 5 is a side perspective view, similar to FIG. 4, with one of two closure straps released from the other.
Figure 6:
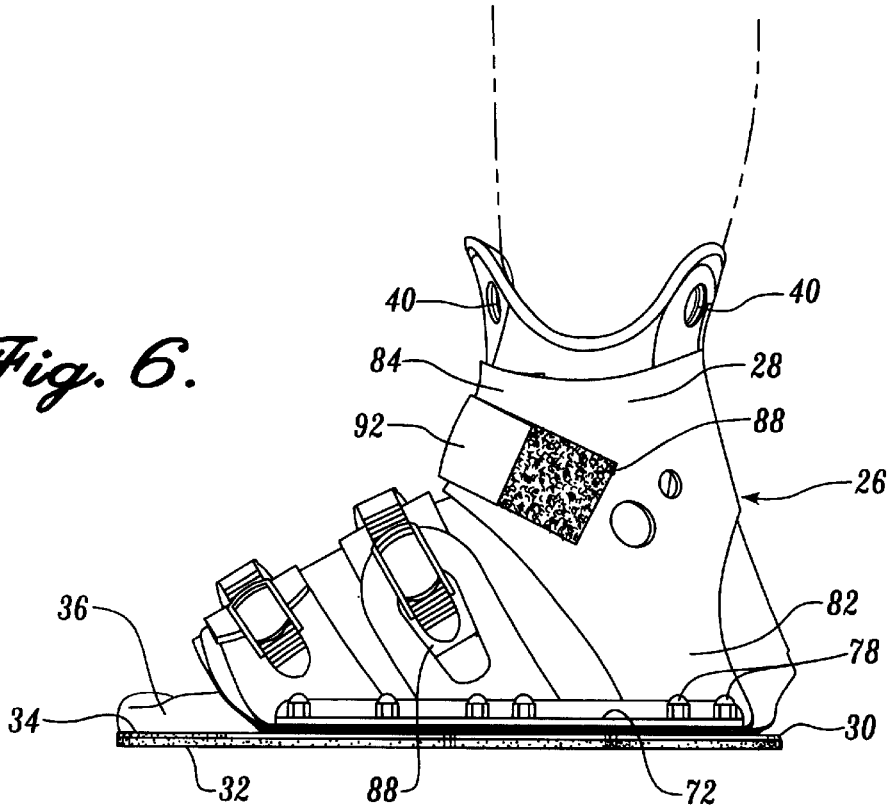
FIG. 6 is a left side view of the wake board binding of FIG. 3.
Figure 7:
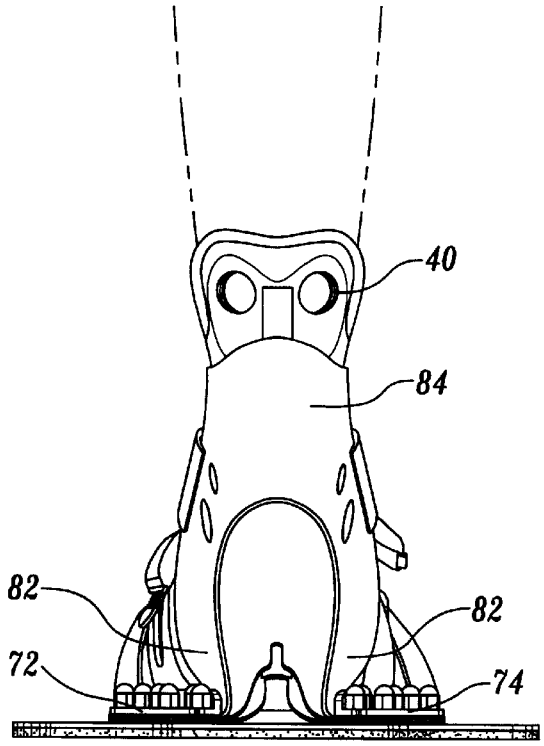
FIG. 7 is a rear view of the wake board binding of FIG. 3.

The stretchable strap 26 is attached under the rearward end of the support rails 72, 74. The stretchable strap 26 includes tabs 82 that extend from underneath the support rails 72, 74 and upward toward the recessed portions 48 on the holster 22. The tabs 82 extend to the annular cuff 28, which is designed to wrap around and attach to the anlde of a user. The annular cuff 28 includes first and second flaps 84, 86 for extending across the front of the ankle of the rider, or the front of the liner sock 24. The first and second flaps 84, 86 include hook and loop material 88, 90 thereon which permits enclosure of the annular cuff 28 about the liner sock 24 and the ankle of the rider. An additional hook and loop strap 92 extends along the outside of the second closure flap 86. The hook and loop material 88 on the first closure flap 84 extends on the inside and outside of the first closure flap, but the VELCRO® 90 on the second closure flap 86 extends only on the outside of the second closure flap (see FIGS. 4 and 5).

The bottom support plate 30 includes a number of apertures (not shown) along its outer surface that act as mounting holes through which bolts (not shown) pass and which are tightened in position by nuts (not shown) to the wake board 21. The whole pattern on the bottom support plate 30 is arranged such as to allow a variety of angular positions for the wake board binding 20 relative to the wake board 21.

In use of the wake board bindings, the first and second closure flaps 84, 86 are disconnected, the first and second buckles 64, 66 are released, and the rider's foot is inserted into the liner sock 24. During this inserting motion, the left and right rigid panels 44, 46 of the holster 22 separate so as to permit the liner sock 24 to expand and to receive the foot of the rider. The foot is positioned in place within the liner sock 24 such that the rider's foot extends along the foot cushion pad 36. The toes of the rider extend outward beyond the end of the liner sock 24.

The first and second buckles 64, 66 are then positioned and snapped into place such that the metatarsal portion of the foot is held comfortably in position between the left and right rigid panels 44, 46 of the holster 22 and against the foot cushion pad 36. The rear of the heel of the rider abuts against the back of the holster 22. Although the rider's foot is held snugly in place, the rider is free to lift the heel of the foot up from the foot cushion pad 36.

Figure 3:
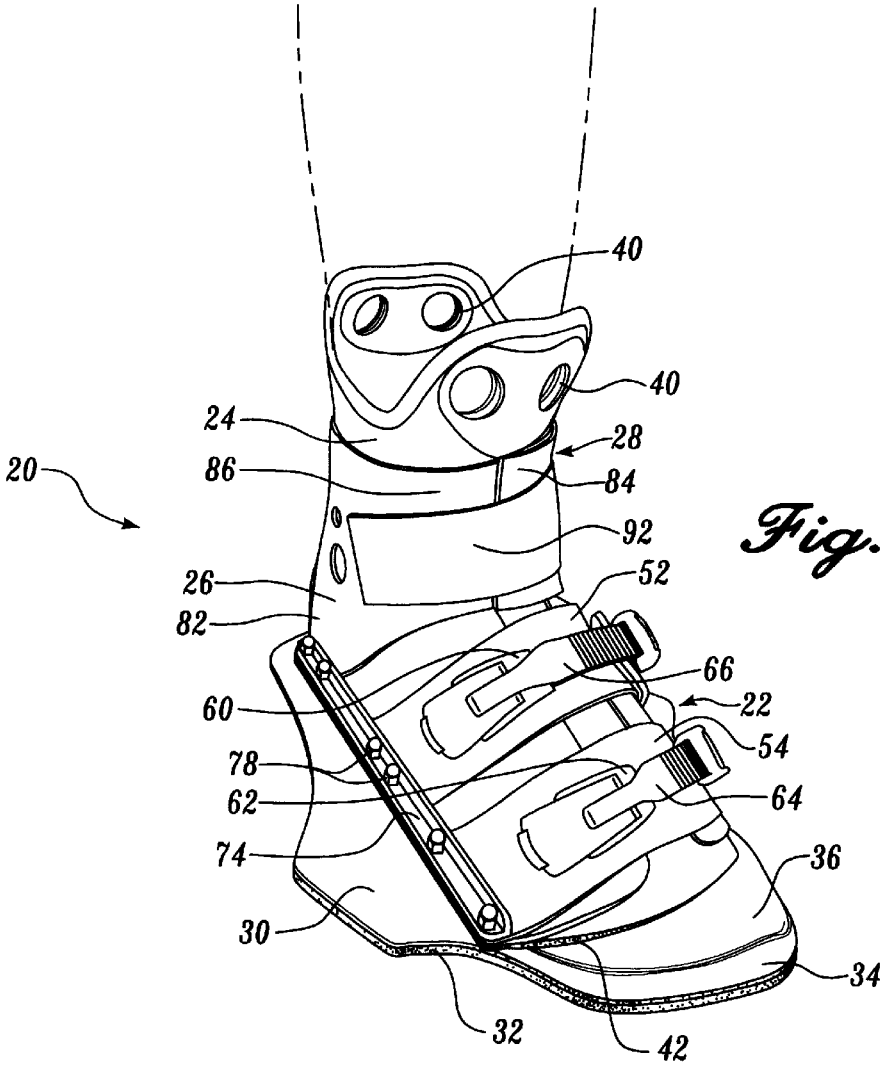
FIG. 3 is a front side perspective of one of the bindings in FIG. 2, with a leg of a rider shown in phantom and an ankle cuff fully fastened about the rider's ankle.

With the heel of the rider against the foot cushion pad 36, the first and second closure flaps 84, 86 are attached around the ankle of the rider so that the ankle is snugly surrounded by the annular cuff 28. To close the annular cuff 28 around the ankle of a rider and the liner sock 24, the second closure flap 86 is pulled snugly across the front of the liner sock 24 (FIG. 5), and the first closure flap 84 is pulled against the top surface of the second closure flap 86 from the position in FIG. 5 to the position in FIG. 4. The hook and loop material 88, 90 on the first and second closure flaps 84, 86 locks in place. The hook and loop strap 92 can then be extended over the outside of the second closure flap 86 (FIG. 3) as an additional locking feature.

Preferably, the annular cuff 28 and the fastened holster 22 work in unison to bind the foot against the surface of the wake board 21. Thus, the rider's foot motion in directly transferred through the wake board binding 20 to the wake board 21 such that the rider can optimally steer and control the wake board 21.

If the rider should fall, the annular cuff 28 is stretchable so that the rider's ankle and foot can slide out of the liner sock 24 and through the annular cuff 28. In addition, the stretchable strap 68 for the second buckle 66 allows the left and right semi-rigid panels 44, 48 of the holster 22 to flex outward so as to allow release of the foot and ankle.

The separate left and right semi-rigid panels 44, 48 permit a variety of foot sizes to fit within the holster 22. In addition, the ability of the left and right semi-rigid panels 44, 48 to flex outwards permits a rider to easily insert his or her foot into the wake board binding 20.

While the preferred embodiment of the invention has been illustrated and described with reference to preferred embodiments thereof, it will be appreciated that various changes can be made therein without departing from the spirit and scope of the invention as defined in the appended claims. For example, while the invention is described with reference to a wake board binding, it is to be understood that the binding could also be used with a water-ski, where there are similar concerns about easy release upon a fall and adjustability of bindings.

The embodiments of the invention in which an exclusive property or privilege is claimed are defined as follows:

1. A binding for a water ski or a wake board comprising:

a semi-rigid left panel for fitting against the left side of a rider's foot;

a semi-rigid right panel for fitting against the right side of a rider's foot;

a buckle extending over the semi-rigid left panel and the semi-rigid right panel, the buckle comprising a stretchable strap, the buckle and the stretchable strap being configured so that when the buckle is in an attached configuration, the buckle and the stretchable strap confine the semi-rigid left panel and the semi-rigid right panel against a foot within the binding and the stretchable strap is capable of stretching so as to release a rider's foot within the binding when the rider falls.

2. The binding of claim 1, further comprising a second buckle extending over the semi-rigid left panel and the semi-rigid right panel, the second buckle being located forward of the first buckle so as to extend closer to the toes of a foot within the binding, the second buckle being configured so that when the second buckle is in an attached configuration, the second buckle confines the semi-rigid left panel and the semi-rigid right panel against a forward portion of a foot within the binding.

3. A binding for a water ski or a wake board comprising:

a first stretchable ankle connector having a lower portion of which is adapted to attach to a wake board or water ski;

an ankle cuff comprised of a stretchable material releasably attachable about the circumference of an ankle of a rider and attached to the first stretchable ankle connector;

a holster of semi-rigid material adapted to extend over the metatarsal portion of a foot of a rider, the holster comprising a senmi-rigid left panel for fitting against a left side of a rider's foot and a semi-rigid right panel for fitting against a right side of a rider's foot; and a first buckle extending over the semi-rigid left panel and the semi-rigid right panel, the first buckle comprising a stretchable strap, the first buckle and the stretchable strap being configured so that when the first buckle is in an attached configuration, the buckle and the stretchable strap confine the semi-rigid left panel and the semi-rigid right panel against a foot within the binding and the stretchable strap is capable of stretching so as to release a rider's foot within the binding when the rider falls.

4. The binding of claim 3, further comprising a second buckle extending over the semi-rigid left panel and the semi-rigid right panel, the second buckle being located forward of the first buckle so as to extend closer to the toes of a foot within the binding, the second buckle being configured so that when the second buckle is in an attached configuration, the second buckle confines the semi-rigid left panel and the semi-rigid right panel against a forward portion of a foot within the binding.

5. A binding for a water ski or a wake board comprising:

a first stretchable ankle connector having a lower portion of which is adapted to attach to a wake board or water ski;

an ankle cuff comprised of a stretchable material releasably attachable about the circumference of an ankle of a rider and attached to the first stretchable ankle connector;

a holster of semi-rigid material adapted to extend over the metatarsal portion of a foot of a rider, the holster comprising a semi-rigid left panel for fitting against a left side of a rider's foot and a semi-rigid right panel for fitting against a right side of a rider's foot; and a first buckle extending over the semi-rigid left panel and the semi-rigid right panel, the first buckle comprising a stretchable strap, the first buckle and the stretchable strap being configured so that when the first buckle is in an attached configuration, the first buckle and the stretchable strap confine the semi-rigid left panel and the semi-rigid right panel against a foot within the binding and the stretchable strap is capable of stretching so as to release a rider's foot within the binding when the rider falls.

6. The binding of claim 5, further comprising a second buckle extending over the semi-rigid left panel and the semi-rigid right panel, the second buckle being located forward of the first buckle so as to extend closer to the toes of a foot within the binding, the second buckle being configured so that when the second buckle is in an attached configuration, the second buckle confines the semi-rigid left panel and the semi-rigid right panel against a forward portion of a foot within the binding.

7. A binding for a water ski or a wake board comprising:

a first stretchable ankle connector having a lower portion of which is adapted to attach to a wake board or a water ski;

an ankle cuff releasably attachable about the circumference of an ankle of a rider and attached to the first stretchable ankle connector;

a holster of semi-rigid material adapted to extend over the metatarsal portion of a foot of a rider; and a liner sock extending into the holster and for receiving a foot of a rider.

8. A binding for a water ski or a wake board comprising:

a first stretchable ankle connector having a lower portion of which is adapted to attach to a wake board;

a stretchable ankle cuff releasably attachable about the circumference of an ankle of a rider and attached to the first stretchable ankle connector;

a holster of semi-rigid material adapted to extend over the metatarsal portion of a foot of a rider, the holster comprising:

a semi-rigid left panel for fitting against the left side of a rider's foot; and a semi-rigid right panel for fitting against the right side of a rider's foot; and a buckle extending over the semi-rigid left panel and the semi-rigid right panel, the buckle comprising a stretchable strap, the buckle and the stretchable strap being configured so that when the buckle is in an attached configuration, the buckle and the stretchable strap confine semi-rigid left panel and the semi-rigid right panel against a foot within the binding and the stretchable strap is capable of stretching so as to release a rider's foot within the binding when the rider falls.

* * * * *